US005273096A

United States Patent [19]

Thomsen et al.

[11] Patent Number: 5,273,096

[45] Date of Patent: Dec. 28, 1993

[54] APPARATUS FOR GRIPPING SHEET FABRIC

[76] Inventors: Jan B. Thomsen, 12 Crouchmans Close, Sydenham Hill, London SE26 6ST, United Kingdom; Kerrin M. Lyons, 63 Farringdon Road, London EC1M 3JB, United Kingdom

[21] Appl. No.: 854,428

[22] Filed: Mar. 19, 1992

[51] Int. Cl.[5] ..... E06B 9/06

[52] U.S. Cl. ..... 160/84.1 R; 160/264

[58] Field of Search ..... 160/84.1, 264, 266, 160/267.1, 268.1, 274, 330

[56] References Cited

U.S. PATENT DOCUMENTS

| | | | |
|---|---|---|---|
| 3,777,800 | 12/1973 | Sosoev | 160/84.1 |
| 4,945,969 | 8/1990 | Schnebly et al. | 160/84.1 |
| 5,072,767 | 12/1991 | Kraeutler | 160/84.1 |

FOREIGN PATENT DOCUMENTS

| | | | |
|---|---|---|---|
| 547643 | 5/1956 | Belgium | 160/264 |
| 99001 | 9/1961 | Denmark | 160/264 |
| 674059 | 4/1939 | Fed. Rep. of Germany | 160/84.1 |
| 2441128 | 4/1975 | Fed. Rep. of Germany | 160/264 |
| 2500245 | 11/1976 | Fed. Rep. of Germany | 160/84.1 |
| 2410117 | 7/1979 | France | 160/84.1 |

*Primary Examiner*—Blair M. Johnson

*Attorney, Agent, or Firm*—Dority & Manning

[57] ABSTRACT

Apparatus for gripping lengths of sheet material as exemplified by fabric for formation of a foldable blind, shade, curtain, partition or the like. Tubular members having longitudinal openings therein are provided which accept the sheet material through the grooves. Rod members also fit within the tubular members, thereby holding the sheet material between the tubular members and the rod members. Guide means are provided to guide pull cords, the guide means engaging a longitudinal groove in each tubular member.

13 Claims, 12 Drawing Sheets

FIG. 9
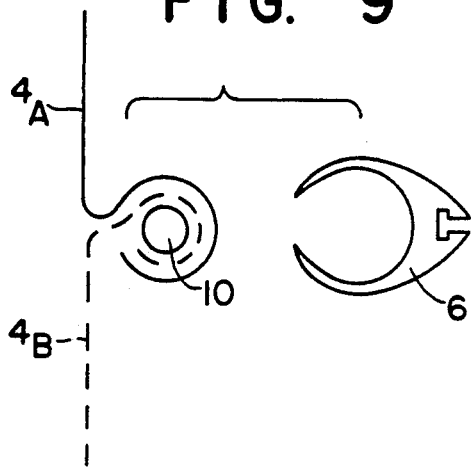
FIG. 10
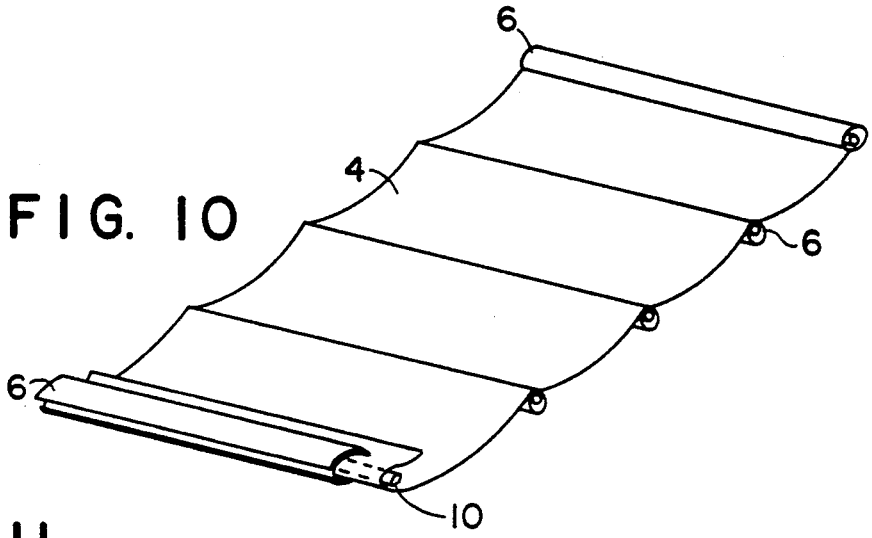
FIG. 11
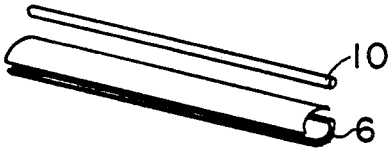
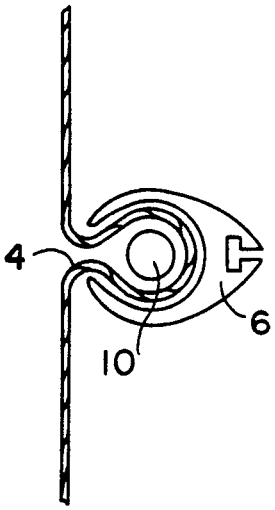
FIG. 12

APPARATUS FOR GRIPPING SHEET FABRIC

This invention relates to apparatus for gripping sheet fabric and, more especially, this invention relates to apparatus for gripping sheet fabric such that the sheet fabric is foldable into a plurality of folds of a predetermined size. This invention also relates to the apparatus when including the sheet fabric.

In accordance with the present invention there is provided apparatus for gripping sheet fabric such that the sheet fabric is foldable into a plurality of folds of a predetermined size, which apparatus comprises a plurality of tubular members, a longitudinally extending opening in each of the tubular members, and a plurality of rod members for fitting inside the tubular members, the apparatus being such that the tubular members and the rod members operate in pairs at spaced apart intervals along the sheet fabric with the spaces between each pair determining the size of the fold and with the fabric passing into and out of each tubular member through the longitudinally extending opening in each tubular member and being retained in the tubular member by being trapped between the tubular member and the rod member in the tubular member.

The apparatus of the present invention may be used for gripping a wide variety of different types of sheet fabric. Thus, for example, the apparatus can be used to grip sheet fabric in the form of blind material to form a blind or a shade. The blind is preferably a roman blind. The apparatus can also be used to grip sheet fabric in the form of shower curtain material to form a shower curtain. The apparatus of the invention can further grip sheet fabric in the form of flag material to form flags and banners. Still further, the apparatus can be used for gripping sheet fabric suitable for decorative purposes to form a window cover or room partitioning. The apparatus can also be used to form a promotional device for promotional purposes.

With the sheet material in position, the apparatus of the invention can be arranged to look aesthetically pleasing. At the same time, the apparatus is easy to produce and use as will be apparent from the description given below.

Usually, the longitudinally extending opening in each tubular member will extend the entire length of the tubular member. The tubular member can then be an extruded tubular member.

Usually, the rod members will be substantially the same length as the tubular members. The rod members are preferably solid rod members but they may be hollow rod members if desired.

The apparatus of the invention may include a headrail having folding means for folding the sheet fabric.

The folding means may comprise a pull cord arrangement. The pull cord arrangement may comprise a pull cord and a plurality of cord guide members secured to the tubular members. Usually, there will be two of the cord guide members for each one of the tubular members.

The cord guide members may each have a closed aperture through which the pull cord is threaded. Alternatively, the cord guide members may each have a slot which leads to an aperture in the cord guide members, the pull cord being passed through the slot and into the aperture during assembly.

The cord guide members may each have a key portion for fitting in a locking groove in the tubular members. Alternatively, the cord guide members may each have a clip portion, then the cord guide members may include a locating portion for locating in a locating groove in the tubular members.

The apparatus of the invention may include gripper means for gripping the pull cord.

The gripper means may comprise a grip member for sliding in a groove in one of the tubular members. Alternatively, the gripper means may comprise a grip member for clipping over one of the tubular members.

The present invention also extends to the apparatus when including the sheet fabric. As indicated above, when the apparatus includes the sheet fabric, it may be used for a wide variety of uses including blinds, curtain rails, flags, partitioning, banners and promotional devices. The blinds are preferably roman blinds.

When the apparatus is formed as a blind, then the blind may have just one piece of the sheet fabric. Alternatively, the blind may have two separate and different pieces of the sheet fabric so that, for example, the top part of the blind might have sheet fabric formed of opaque see-through curtain material whilst the bottom part of the blind might have sheet fabric formed of non see-through curtain material. More than two different types of sheet fabric material may be used if desired. The fabric may be of a different construction or just of a different color, as may be desired by the end user.

Embodiments of the invention will now be described solely by way of example and with reference to the accompanying drawings in which:

FIG. 9 is an exploded end view of part of an alternative blind with two different pieces of sheet FIGS. 10–12 illustrate different component parts of a blind of the type shown in FIG. 1 and also illustrate how the blind is formed;

Figure 1:
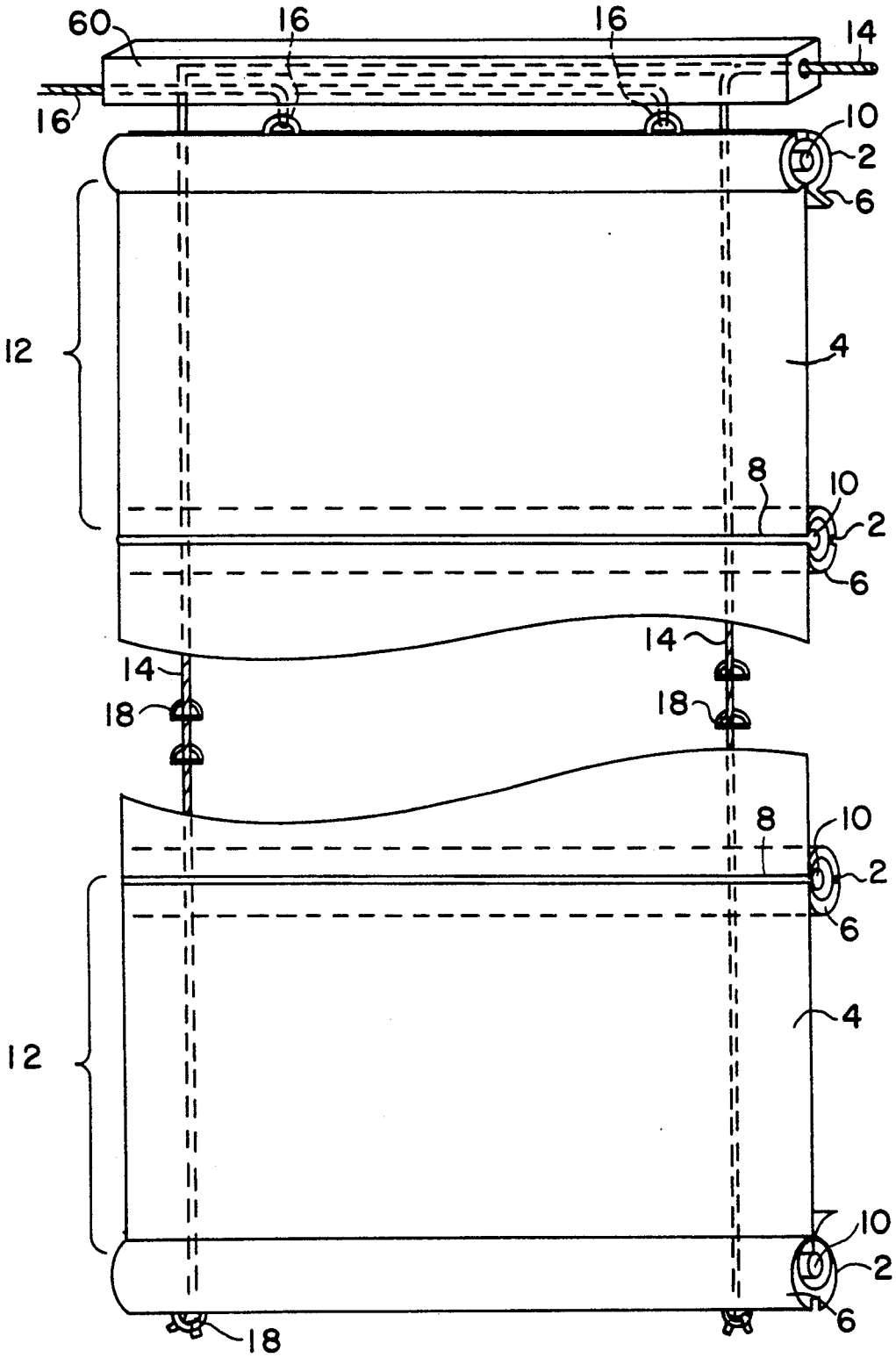
FIG. 1 is a perspective view of a blind.
Figure 2:
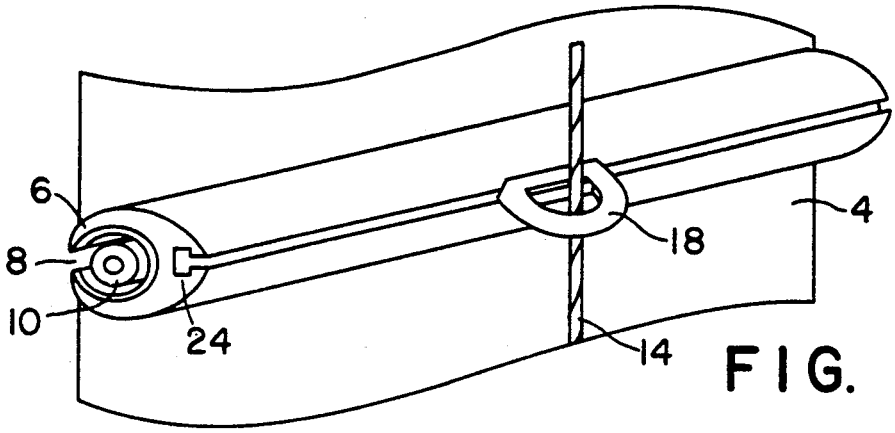
FIG. 2 shows in detail the operating action of a tubular member, a rod member sheet fabric, a guide member and a pull cord.
Figure 3:
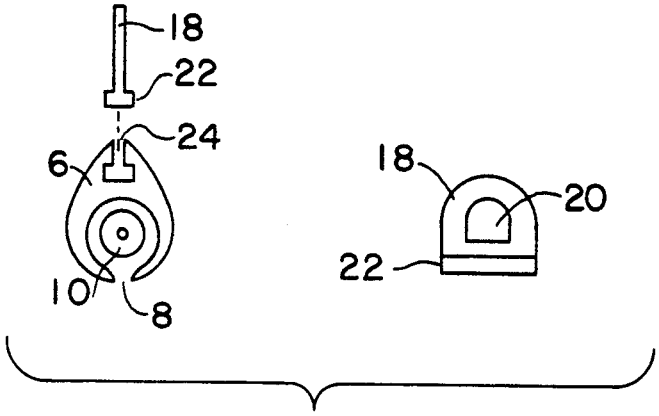
FIG. 3 is an end view of a top tubular member, its rod member and its cord guide member, the cord guide member also being shown in plan.

Referring to FIGS. 1 to 3, there is shown apparatus 2 for gripping sheet fabric 4 such that the sheet fabric 4 is foldable into a plurality of folds of a predetermined size.

The apparatus 2 comprises a plurality of tubular members 6. Each tubular member 6 has a longitudinally extending opening 8. The apparatus 2 further comprises a plurality of rod members 10 for fitting inside the tubular members 6. As can be seen from FIG. 1, the tubular members 6 and the rod members 10 operate in pairs at spaced apart intervals along the length of the sheet fabric 4, with the spaces 12 between each pair determining the size of the fold and with the fabric 4 passing into and out of each tubular member (see FIG. 2) through the longitudinally extending opening 8. The fabric 4 is also retained in the tubular member 6 by being trapped between the tubular member 6 and the rod member 10 in the tubular member 6. As can be seen from FIG. 1, when the apparatus 2 is viewed from the front, the fabric 4 tends to hide the tubular members 6 and the rod members 10, and the entire blind is aesthetically pleasing whilst being easy to construct, assemble, disassemble and use.

The opening 8 in each tubular member 6 extends the entire length of the tubular member 6. Thus the tubular members 6 can easily be extruded. The rod members 10 can also easily be extruded and they will usually be of the same length as the tubular members 6. The rod members 10 may be solid or hollow. The rod members 10 may be made of a transparent material or they may be made to be opaque and/or colored.

Figure 4:
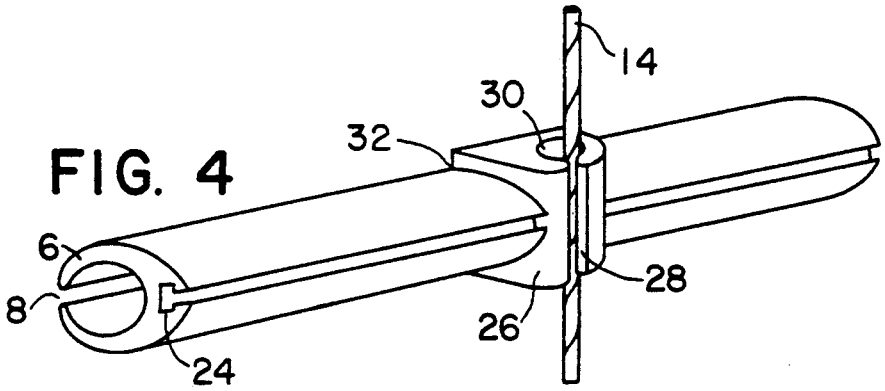
FIG. 4 shows an alternative arrangement to that shown in FIG. 2.

The apparatus 2 includes a headrail having folding means in the form of a pull cord arrangement for folding the sheet fabric when it is desired to pull the blind up or down. The pull cord arrangement comprises pull cords 14, 16 and a plurality of cord guide members 18. Two different types of cord guide members 18 are shown in FIGS. 2 and 4. The cord guide members 18 are secured to the tubular member 6 and there will usually be two of the cord guide members 18 employed for each tubular member 6. As can be seen from FIGS. 2 and 3, each cord guide member 18 has a closed aperture 20 through which the pull cord 16 is threaded. The cord guide members 18 also have a key portion 22 (see FIG. 3) for fitting in a locking groove 24.

It will be appreciated that FIG. 3 shows the uppermost tubular member 6 in FIG. 1 and this tubular member 6 is rotated through 90° with respect to the intermediate tubular member 6. The lowermost tubular member 6 shown in FIG. 1 is 180° rotated with respect to the uppermost tubular member 6 as shown in FIG. 1. These various positions of the tubular member 6 are required to make sure that the opening 8 in each tubular member 6 faces the correct way.

Figure 5:
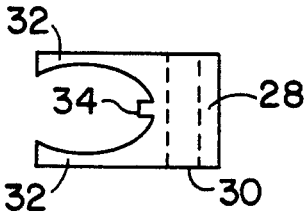
FIG. 5 is an end view of the arrangement shown in FIG. 4.

Referring now to FIGS. 4 and 5, there is shown a cord guide member 26 which is an alternative to the cord guide members 18 shown in FIGS. 2 and 3. The cord guide member 26 shown in FIGS. 4 and 5 has a slot 28 which leads to an aperture 30 in the cord guide member 26. With the cord guide member 18 shown in FIG. 2, the pull cord 16 first has to be threaded through the cord guide members 18 so that the tubular members 6 with the sheet fabric 4 attached will then normally be offered up to a hanging pull cord 16 with attached cord guide members 18. In the arrangement shown in FIGS. 4 and 5, the cord guide members 26 can be attached to tubular members 6 and the sheet fabric 4 and then connected to the pull cords 16.

The cord guide member 26 shown in FIGS. 4 and 5 has a clip portion 32 for clipping over the tubular members 6. The cord guide member 26 also has a locating portion 34 for locating in a groove in the tubular member 6.

Figure 6:
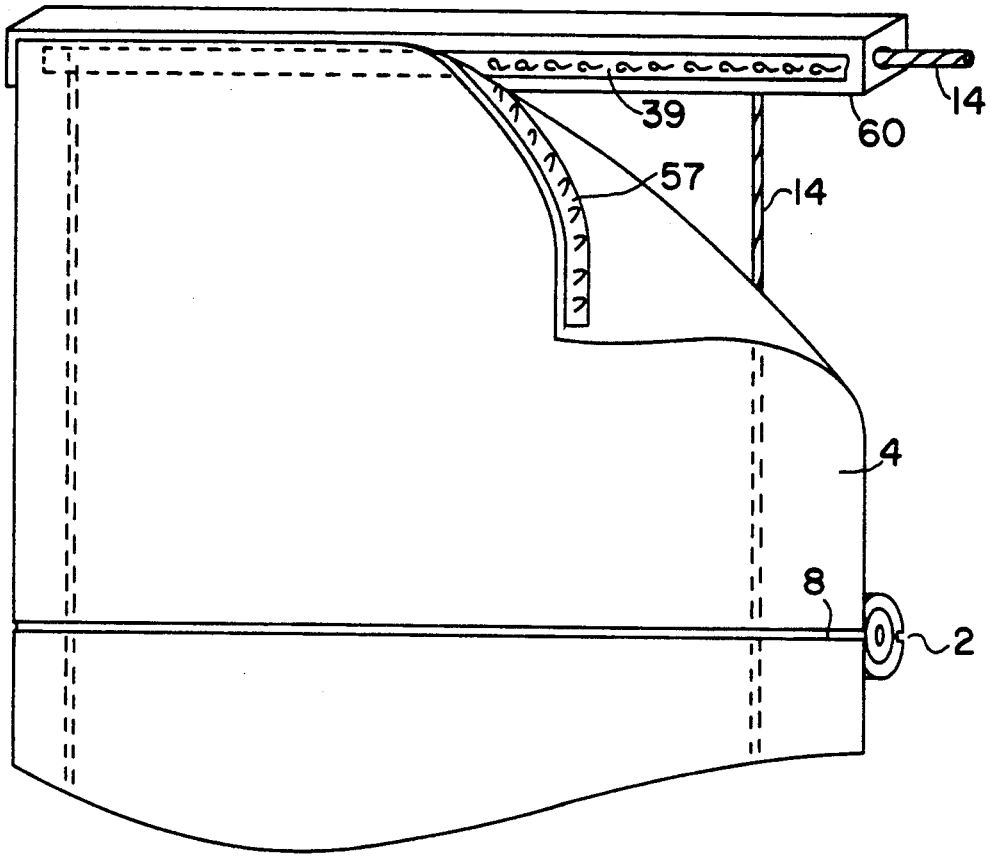
FIG. 6 shows an alternative way to that shown in FIG. 1 of connecting sheet fabric to a headrail.

FIG. 6 shows a headrail 60 which has the fabric 4 attached to it by velcro (Registered Trade Mark) strips 37, 39. The velcro strips 37, 39 are in the form of velcro tape. The velcro strips 37, 39 allow the sheet fabric 4 simply and easily to be fixed and removed from the headrail 60.

Figure 7:
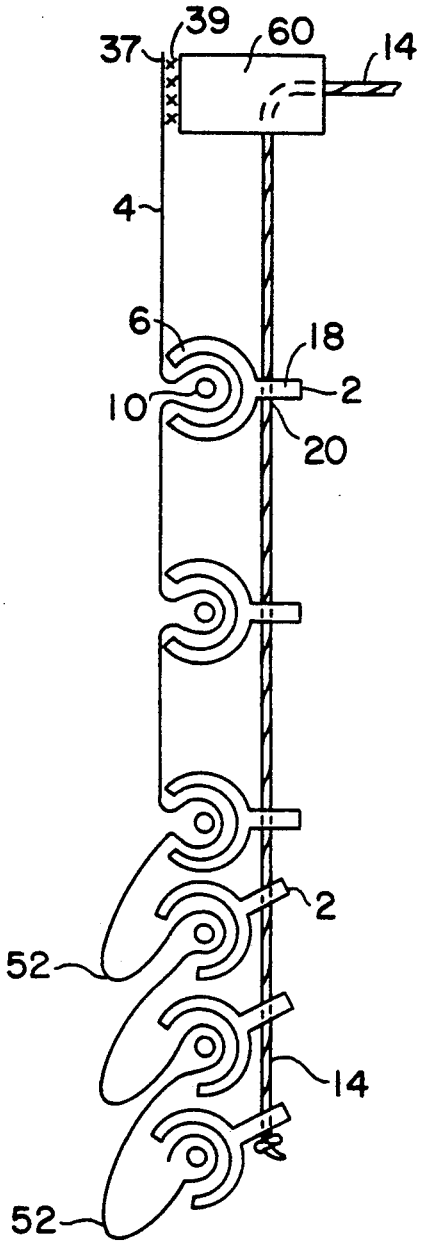
FIG. 7 is a side view of a blind like that shown in FIG. 6 and illustrates how the blind folds when it is upwardly by a pull cord.

FIG. 7 is a side view of the apparatus 2 as shown in FIG. 6 and illustrates how the sheet fabric 4 is formed into folds 52 when the pull cord 14 is pulled and the blind is raised up. FIG. 7 also illustrates the action which occurs in FIG. 1.

Figure 8:
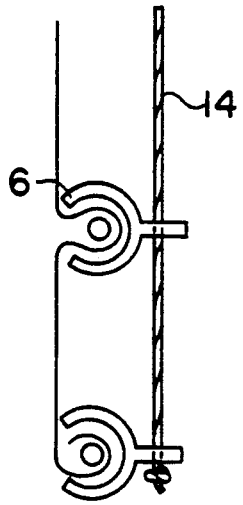
FIG. 8 shows the bottom of the blind of FIG. 7 but to being pulled upwardly.
Figure 13:
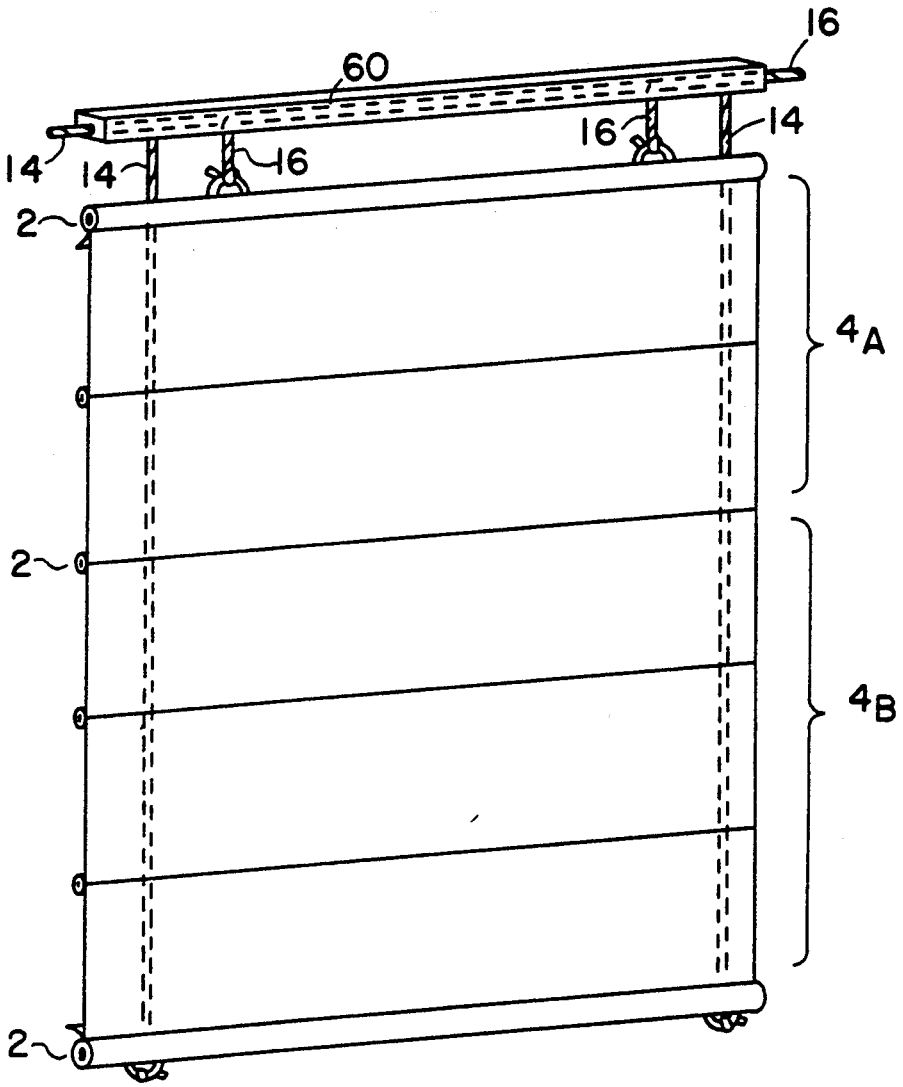
FIG. 13 shows another blind in which the top of the blind can be lowered, and in which the blind comprises two different types of sheet fabrics.
Figure 14:
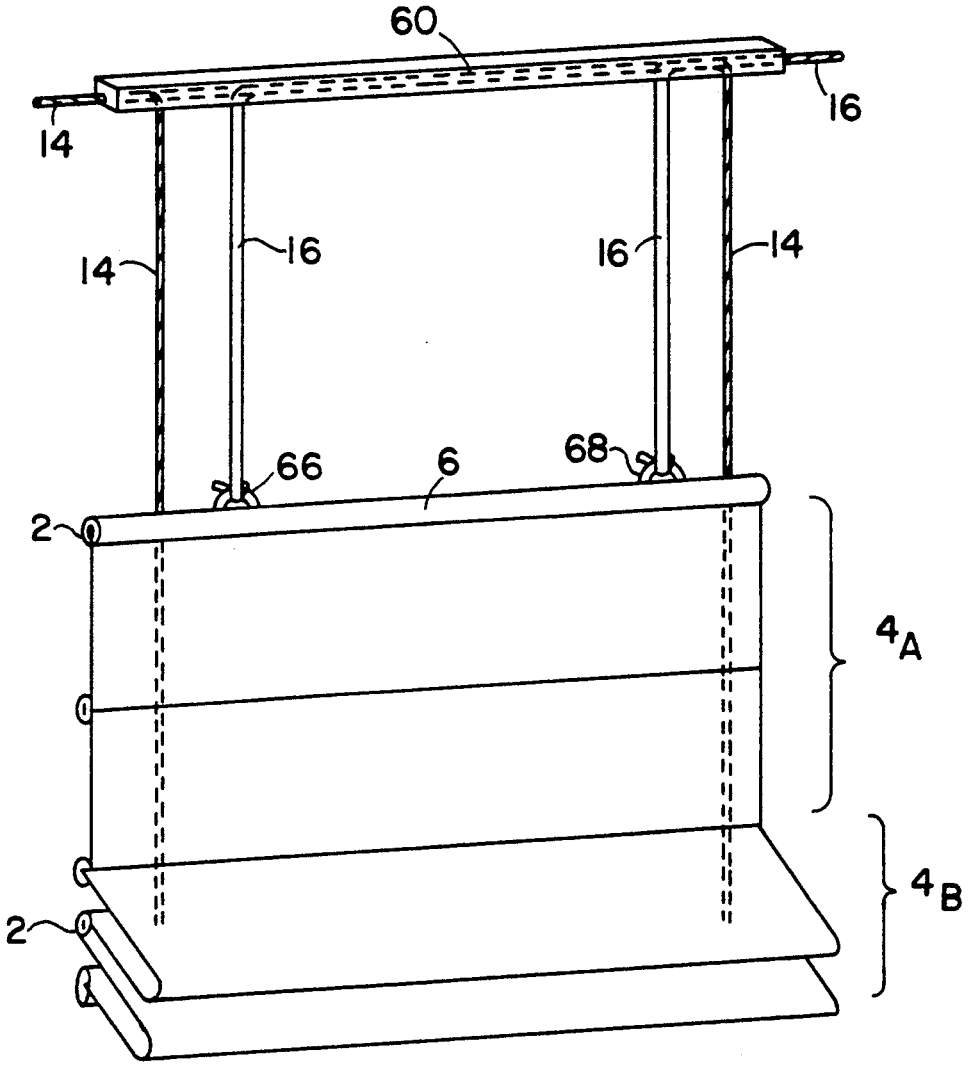
FIG. 14 shows the blind of FIG. 13 with the top part of the sheet fabric lowered.

FIG. 8 shows the bottom of the arrangement shown in FIG. 7 but prior to pulling on the pull cord 14. From a comparison of FIGS. 7 and 8, it will be seen how the bottom tubular member 6 tends to rotate as it is pulled up. During pulling, the various tubular members engage on each other to form pleats. Thus the spacing apart of the tubular members 6 and their cooperating rod members 10 define the pleats, the size of the pleats being approximately half the distance between the tubular members 6.

FIG. 9 illustrates how the rod member 10 and a tubular member 6 can be used to trap two pieces of sheet fabric 4A and 4B.

Referring now to FIGS. 10 to 14, FIG. 10 shows how sheet fabric 4 can be cut to a required width and length and then provided with the tubular members 6 at desired spaced apart intervals. FIG. 11 shows how a rod member 10 can be cut to length and then engaged in tubular members 6 of equal length. The rod member 10 can be rounded at one end for sliding in the tubular members 6 from one end of the tubular members 6. Alternatively, the rod member 10 can be pushed into the tubular members 6 through the opening 8 in the tubular members 6. FIG. 12 shows a rod member 10 located in a tubular member 6 and trapping the fabric 4.

Figure 15:
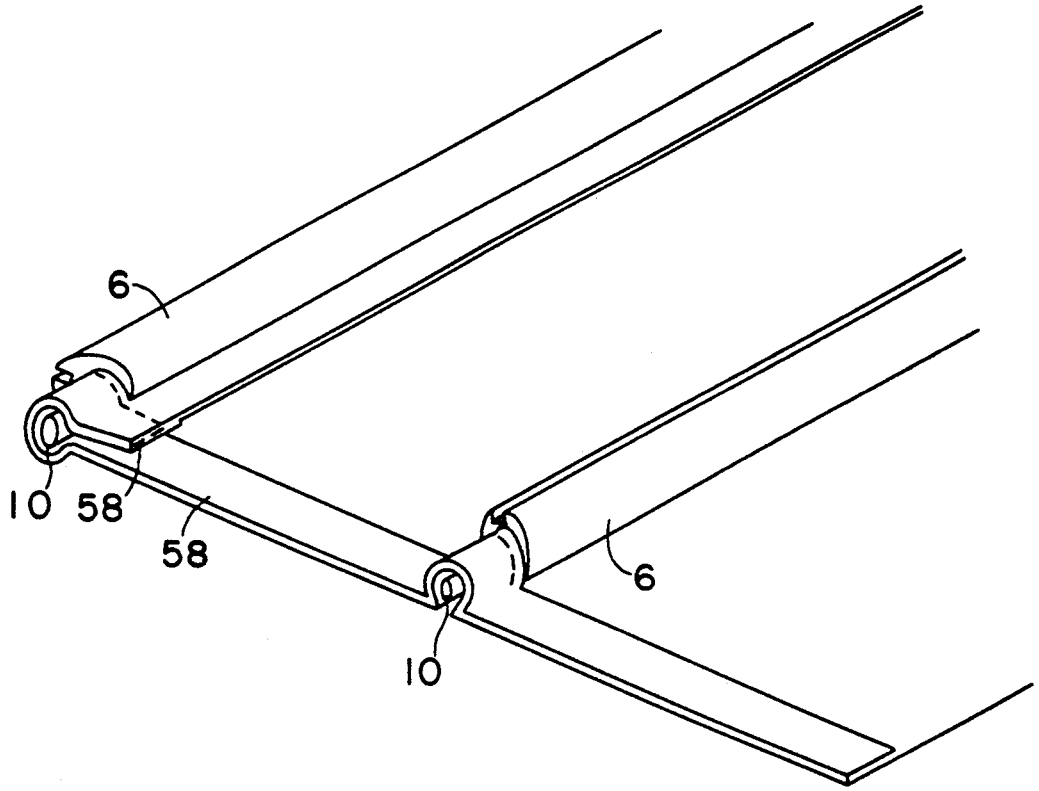
FIGS. 15–17 show different parts of the blind shown 13.

FIG. 15 shows how the fabric 4 may have a hem 58 and this hem may consist of two or more fabric layers. The hem may be too thick to be accommodated between a pair of locking members constituted by a tubular member 6 and a rod member 10. In this case, the hem 58 can extend beyond the ends of the tubular members 6 and the rod members 10. Alternatively, the aperture in each tubular member 6 may be enlarged.

Figure 16:
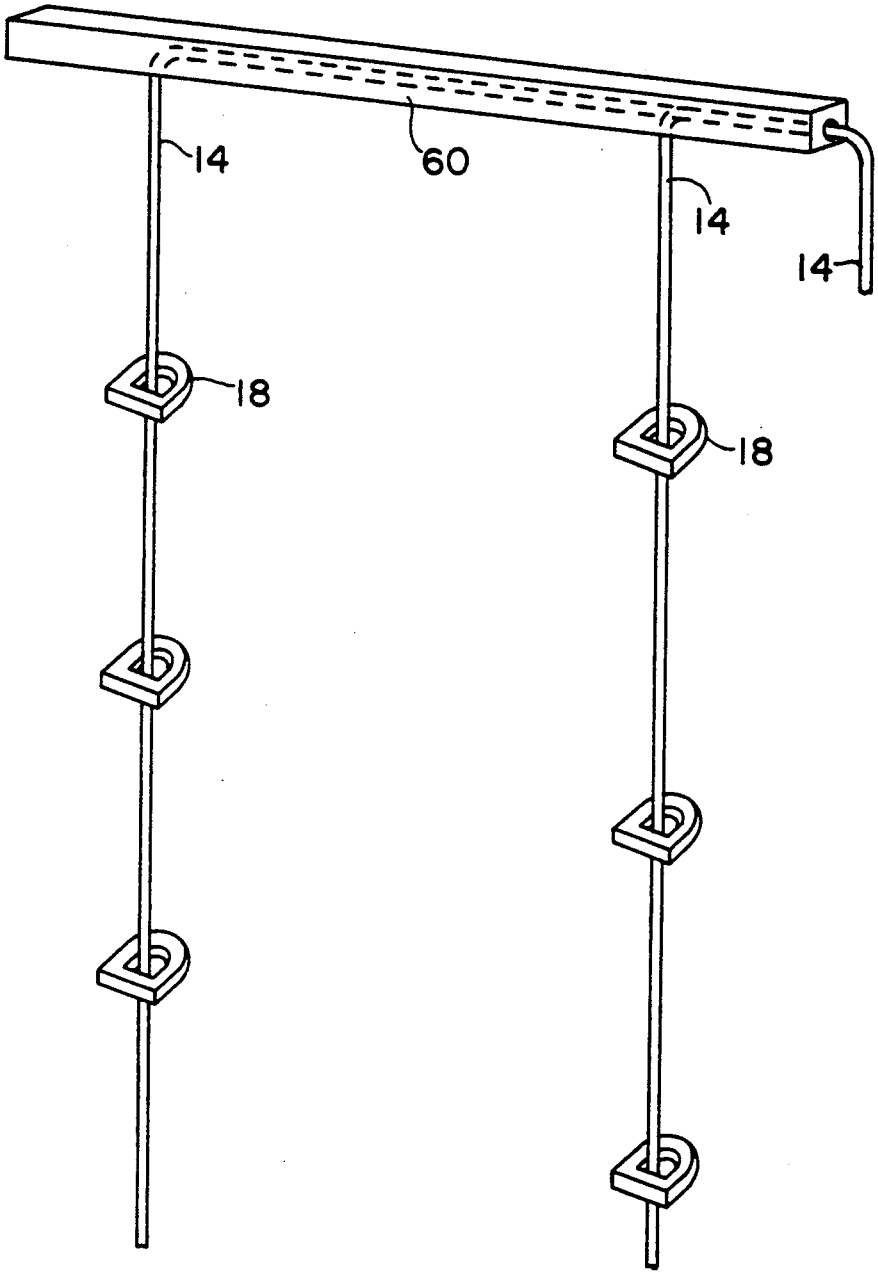
Figure 17:
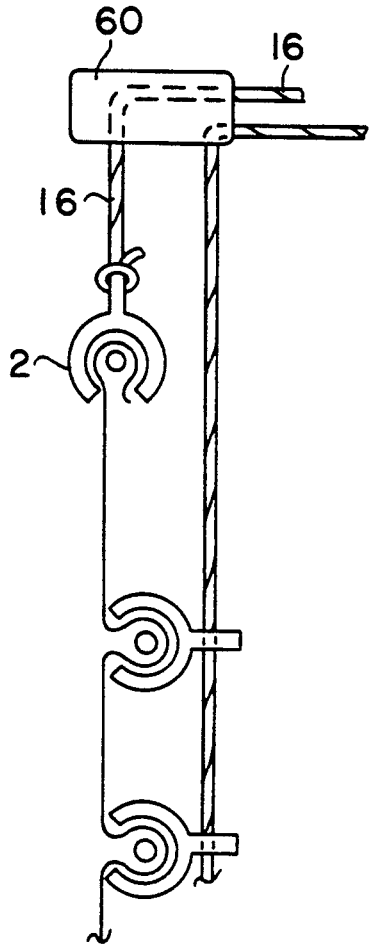

FIG. 16 shows the above mentioned pull cord arrangement and illustrates particularly the pull cord 14 and the cord guide members 18 handing from a headrail 60. The headrail 60 may be a standard headrail 60 of the type currently used for venetian blinds. When the fabric is provided with the tubular members 10 as shown in FIG. 10, then the fabric 4 with the tubular members 6 can be offered up to the pull cord arrangement as shown in FIG. 16 and the cord guide members 18 can then be located in the locking grooves 24.

Referring back to FIG. 13, there is shown apparatus 2 in the form of a blind with the first part of the fabric 4 being in the form of net curtain 4A, and with the second part of the fabric 4 being in the form of full curtain 4B. A height adjusting pull cord arrangement is shown comprising a pull cord 16. This pull cord 16 is also shown in FIG. 1. A pull c©rd 16 is effective to raise and lower the uppermost tubular member 6 as can be seen from a comparison of FIGS. 13 and 14. As can be seen most clearly from FIG. 14, the pull cord 16 is attached to the uppermost tubular member 6 at positions 66, 68. Any appropriate attachment members such as C-shaped clips or other devices may be employed.

It will be seen from the drawings that the apparatus 2 is able to hold the fabric 4 in a horizontal manner at top, bottom and intermediate positions as required. The apparatus can easily be dismantled to allow cleaning of the sheet fabric 4, for example in a washing machine. The various parts of the apparatus 2 may be produced from any desired and appropriate materials, although plastics materials will usually be preferred. The plastics materials can easily be molded to shape. Any fabric 4 or mixtures of fibers and fabric 4 can be used. The fabric may be given options such as hemming, selfedge and overlock. Where mixture of fabrics are employed, this may be ideal for street level windows in houses or offices. The fabric may be lined or unlined.

It is to be appreciated that the embodiments of the invention described above with reference to the accompanying drawings have been given by way of example only and that modifications may be effected. Thus, for example, the pull cord 14 and/or the pull cord 16 may be replaced by powered drives. In this case, one or more electric motors may be employed and powered drive means may be employed for domestic, hotel, retail and commercial purposes.

Figure 18:
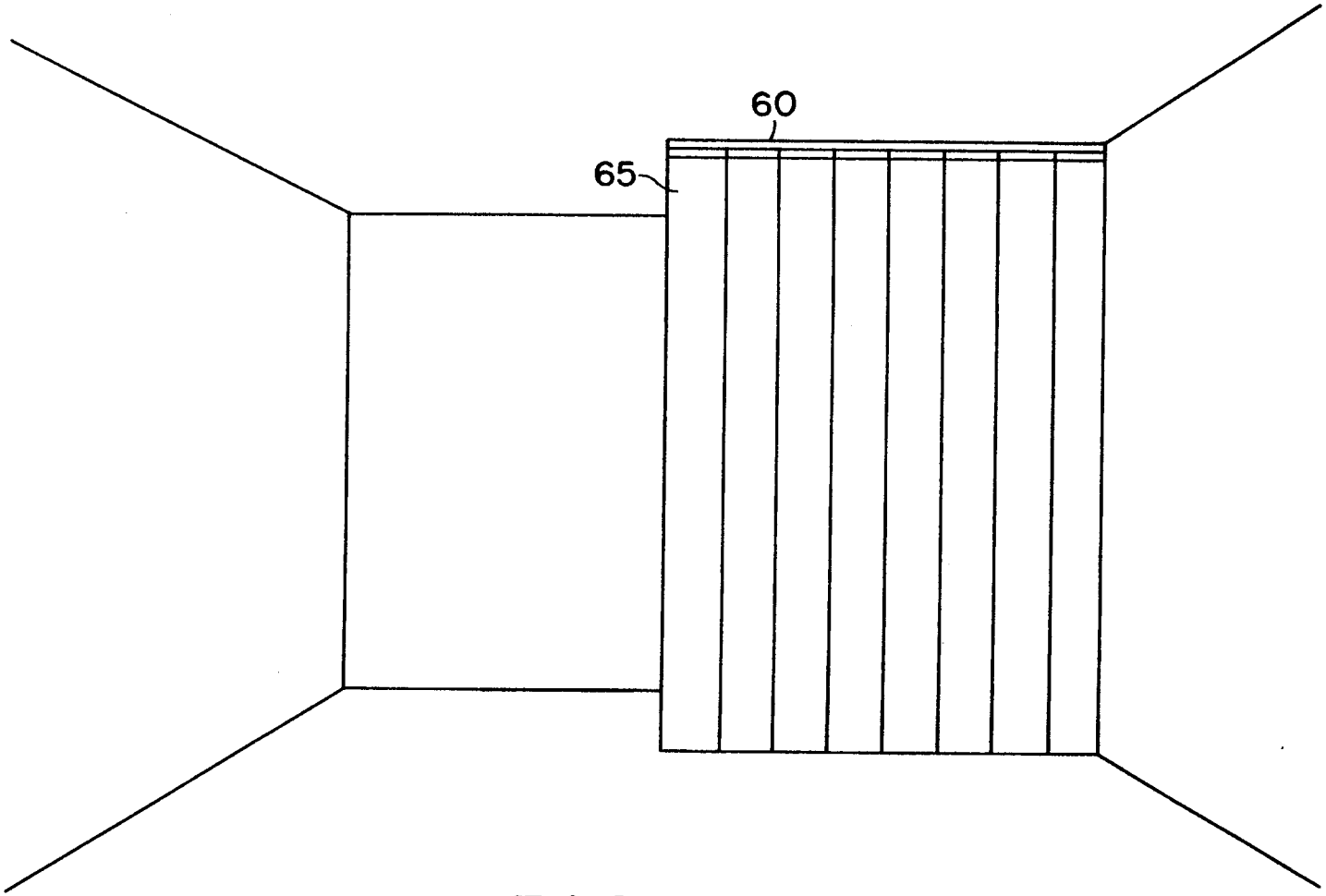
FIG. 18 shows the apparatus of the invention used as a room divider in a room.

The apparatus 2 can also be produced to form room curtain partitioning or shower curtains. In such cases, the tubular members and the rod members shown in the drawings will generally be turned through 90° to the vertical position. One such use of the apparatus 2 as room curtain partitioning 65 is shown in FIG. 18. A similar arrangement may be used for shower curtains. The tubular members 6 and the rod members 10 may be effective to stop billowing of the shower sheet fabric 4 and this may be advantageous in preventing water from dripping down the shower sheet fabric 4 and on to a floor outside a shower cubicle, tray or bath. Appropriate weight rods can be employed if vertical shower apparatus needs more weight than curtain apparatus. Where the apparatus is formed as a partition shown in FIG. 18, then the curtain will usually be moved by hand so that the pull cord arrangement will not normally be required.

The apparatus 2 can also be used for promotional purposes for use by retail and commercial companies. Banners, signs and flags can be used for advertising purposes. Thus, for example, vertically hanging banners with an assembly similar to the apparatus when it is used in a window blind mode may present any desired information at almost any desired scale. In this embodiment of the invention, a lifting pull cord arrangement would probably not be needed.

Figure 19:
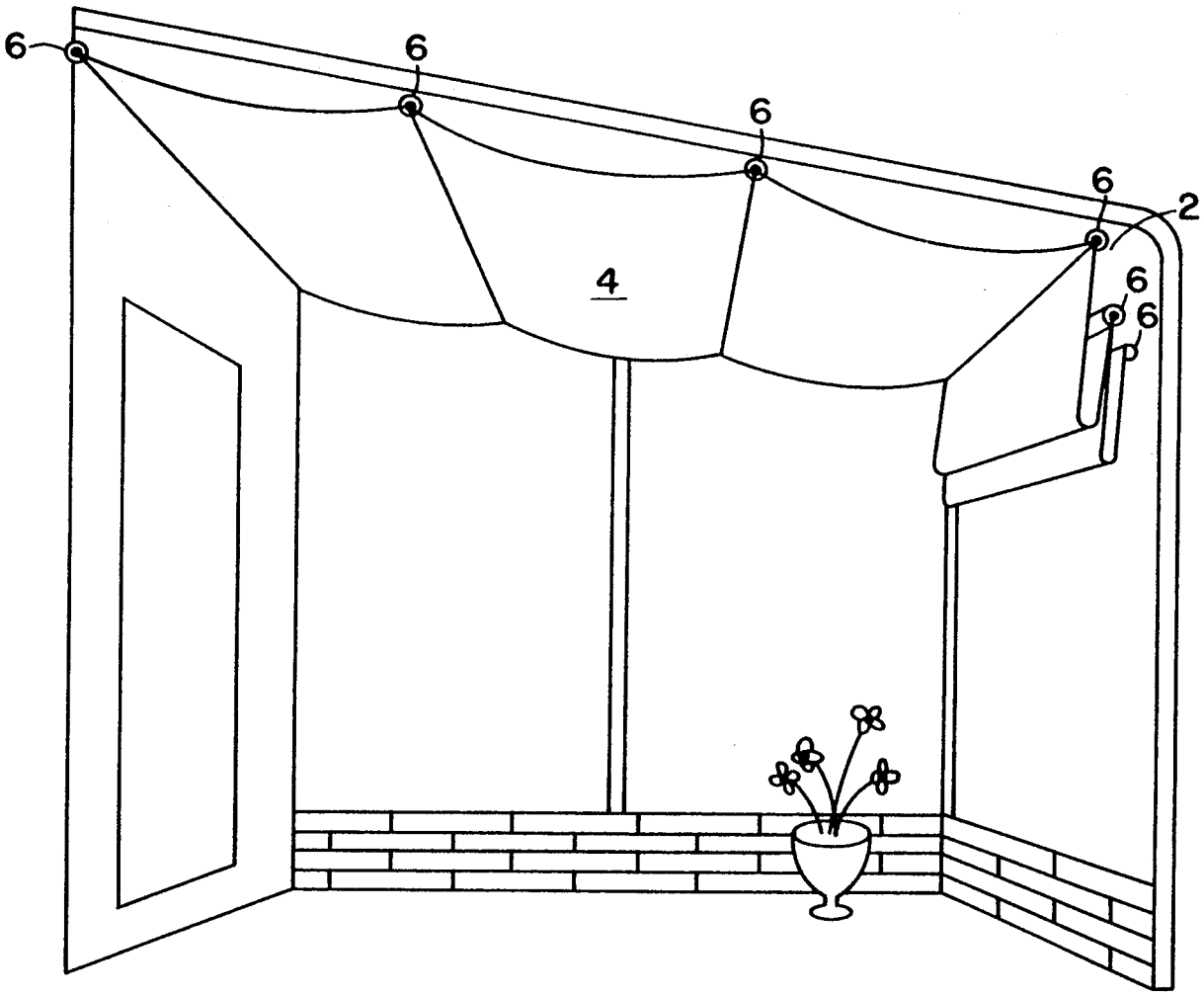
FIG. 19 shows the apparatus of the invention used in a conservatory for covering and uncovering the roof of the conservatory.

As shown in FIG. 19, the apparatus 2 may also be used as a blind for a conservatory roof 67. In such an arrangement, the apparatus 2 may operate at an inclined angle as opposed to a vertical angle in front of windows.

If desired, the apparatus 2 can also be used as door partitioning and generally for any other desired and appropriate purposes for which some form of screwing is required.

We claim:

1. Apparatus for gripping sheet fabric such that the sheet fabric is foldable into a plurality of folds of a predetermined size, which apparatus comprises a plurality of tubular members, a longitudinally extending opening in each of the tubular members, and a plurality of rod members for fitting inside the tubular members, the apparatus being such that the tubular members and the rod members operate in pairs at spaced apart intervals along the sheet fabric with the spaces between each pair determining the size of the fold and with the fabric passing into and out of each tubular member through the longitudinally extending opening in each tubular member and being retained in the tubular member by being trapped between the tubular member and the rod member, said apparatus further including a headrail and a pull cord arrangement for folding the sheet fabric, said pull cord arrangement comprising a pull cord and a plurality of cord guide members, said guide members each having a key portion for fitting into a locking groove in a tubular member.

2. Apparatus according to claim 1 in which the longitudinally extending opening in each tubular member extends the entire length of the tubular member.

3. Apparatus according to claim 2 in which the tubular members are extruded tubular members.

4. Apparatus according to claim 1 in which the rod members are of substantially the same length as the tubular members.

5. Apparatus according to claim 1 in which the rod members are solid rod members.

6. Apparatus according to claim 1 in which the rod members are hollow rod members.

7. Apparatus according to claim 1 in which the cord guide members each have a closed aperture through which the pull cord is threaded.

8. Apparatus according to claim 1 in which the cord guide members each have a slot which leads to an aperture in the cord guide members, the pull cord being passed through the slot and into the aperture during assembly.

9. Apparatus according to claim 1 in which the cord guide members each have a clip for clipping over the tubular members.

10. Apparatus according to claim 1 and including the sheet fabric.

11. Apparatus according to claim 10 and in the form of a blind.

12. Apparatus for gripping sheet fabric such that the sheet fabric is foldable into a plurality of folds of a predetermined size, which apparatus comprises a plurality of tubular members, a longitudinally extending opening in each of the tubular members and a plurality of rod members for fitting inside the tubular members, the apparatus being such that the tubular members and the rod members operate in pairs at spaced apart intervals along the sheet fabric with the spaces between each pair determining the size of the fold and with the fabric passing into and out of each tubular member through the longitudinally extending opening and being retained in the tubular member by being trapped between the tubular member and the rod member, said apparatus further including a headrail and a pull cord arrangement which comprises a pull cord and a plurality of cord guide members secured to the tubular members, each said guide member being adapted to clip around a respective one of said tubular members and having a means thereon for sliding in a groove in said tubular member.

13. Apparatus for gripping a fabric sheet at spaced apart intervals along its length to form a plurality of folds in said fabric sheet, said apparatus comprising a headrail and a pull cord associated therewith, a plurality of tubular members, said tubular members defining a longitudinally extending opening therealong, a rod member for each tubular member for filling inside said longitudinally extending opening for trapping a portion of fabric sheet therewithin, and a plurality of cord guide members defining an opening for passage of said pull cord therethrough, said guide members having a key portion thereacross for fitting into a locking groove in a tubular member.

* * * * *